US008230538B2

(12) United States Patent
Moret et al.

(10) Patent No.: US 8,230,538 B2
(45) **Date of Patent: *Jul. 31, 2012**

(54) MATTRESS INNERSPRING INSERTS AND SUPPORTS

(75) Inventors: David Michael Moret, Winston-Salem, NC (US); Larry K. DeMoss, Greensboro, NC (US); Brian M. Manuszak, Thomasville, NC (US); James A. Beamon, Jamestown, NC (US)

(73) Assignee: Sealy Technology LLC, Trinity, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/005,723

(22) Filed: Jan. 13, 2011

(65) Prior Publication Data

US 2011/0107523 A1 May 12, 2011

Related U.S. Application Data

(63) Continuation-in-part of application No. 12/960,735, filed on Dec. 6, 2010, which is a continuation of application No. 12/248,607, filed on Oct. 9, 2008, now Pat. No. 7,845,035, which is a continuation-in-part of application No. 12/016,374, filed on Jan. 18, 2008, now Pat. No. 7,636,971.

(51) Int. Cl.
*A47C 23/04* (2006.01)

(52) U.S. Cl. ..... 5/718; 5/727; 5/730; 5/740

(58) Field of Classification Search ..... 5/691, 718, 5/727, 730, 731, 736, 740, 655.9
See application file for complete search history.

(56) References Cited

U.S. PATENT DOCUMENTS

| | | | |
|---|---|---|---|
| 3,618,146 | A | 11/1971 | Ferdinand |
| 3,822,426 | A | 9/1974 | Mistarz |
| 5,210,890 | A | 5/1993 | Hagglund |
| 5,239,715 | A | 8/1993 | Wagner |
| 469,590 | A | 11/1995 | Simon |

(Continued)

*Primary Examiner* — William Kelleher
(74) *Attorney, Agent, or Firm* — James C. Scott; Roetzel & Andress

(57) ABSTRACT

Innerspring dampening foam inserts are disclosed in various combinations with mattress innersprings having a plurality of helical form coils interconnected in an array in which the coils are generally aligned in rows and columns, each of the coils having a generally cylindrical coil body formed by helical turns of wire with openings between each of the helical turns of wire, and first and second ends to the coil body also formed by the wire, each of the coil bodies being spaced apart in the array. At least one innerspring insert is inserted into an innerspring in spaces or channels between the spaced apart coils. The innerspring dampening inserts, which are preferably made of foam, may have a generally H-shaped configuration with upper and lower parallel lateral members and a transverse member that extends between and bisects the upper and lower lateral members. In another embodiment, the innerspring inserts may be generally T-shaped having a lower lateral member, a vertical member which is perpendicular to and bisects the lower lateral member and a lateral extension which extends outward from one side of the vertical member. The innerspring inserts may create or define zones or regions of the innerspring which have different support characteristics from other zones or regions by dampening or altering the spring rates and support characteristics of the innerspring in the areas or regions where the insert are located. The innerspring inserts may also be placed at or near the border or edges of the innerspring to provide increased stability in the perimeter or edge areas of the support surface of a mattress.

21 Claims, 7 Drawing Sheets

U.S. PATENT DOCUMENTS 5,467,488 A 11/1995 Wagner
5,687,439 A 11/1997 Wagner
5,787,532 A 8/1998 Langer et al.
5,832,551 A 11/1998 Wagner
6,023,803 A 2/2000 Barman
6,128,798 A 10/2000 Barman et al.
7,082,635 B2 8/2006 Barman et al.
7,636,971 B2 12/2009 DeMoss

MATTRESS INNERSPRING INSERTS AND SUPPORTS

RELATED APPLICATIONS

This application is a continuation-in-part of U.S. patent application Ser. No. 12/960,735 entitled "Posture Channel Supports", filed on Dec. 6, 2010, which is a continuation of U.S. patent application Ser. No. 12/248,607 entitled "Pressure Dispersion Support System", filed on Oct. 9, 2008 now U.S. Pat. No. 7,845,035, which is a continuation-in-part of U.S. patent application Ser. No. 12/016,374, entitled "Innerspring Dampening Inserts", filed on Jan. 18, 2008 now U.S. Pat. No. 7,636,971, all of which are incorporated herein by reference in their entirety.

FIELD OF THE INVENTION

The present invention is in the field of reflexive support systems, springs and spring systems, including support systems for humans such as seating and bedding.

BACKGROUND OF THE INVENTION

Different types of springs and spring systems are commonly used as the reflexive core of seating and support products such as chairs and mattresses. A common spring system which is used in mattresses and some upholstered furniture is the so-called "innerspring" which can be in one form a plurality of similarly or identically formed springs which are interconnected in an array or matrix. An innerspring provides a distributed generally homogeneous reflexive support system to give underlying support to an expanse such as the sleep surface of a mattress. The uniform spring rate across the expanse results from the common configuration of each of the interconnected springs. Attempts to alter the spring rate and feel of an entire innerspring or support area of an innerspring involve the use of different types and amounts of materials such as foam, textiles and natural fibers as overlays on the innerspring. While the use of such materials does alter the feel and performance of the support system, it does not of course alter the spring rate of the underlying or internal innerspring.

Innersprings which are made of formed steel wire and are manufactured by wire forming machinery which forms the individual springs or coils, and then connects them together by smaller lacing wires or other fasteners. Once the machines are set up to make a particular spring or coil design and interconnection, large runs are made and it is difficult to change the form of the springs and innerspring. Therefore, with current innerspring production technology, it is not practical to produce a single innerspring which has variable or non-homogenous spring rates and support characteristics in different areas of the innerspring.

SUMMARY OF THE INVENTION

In one embodiment, mattress innerspring inserts and supports are disclosed in combination with innersprings having a plurality of springs connected together in an array wherein the springs are arranged in rows and columns, each spring having a body with a first end and a second end, the body of each spring being generally cylindrical and having a longitudinal axis and an outer diameter, the springs being spaced apart in the rows and columns and connected together in a spaced apart arrangement with each spring being spaced from each adjacent spring in the array. At least one innerspring insert or innerspring dampening foam insert is engaged with the innerspring in spaces between springs of the innerspring, the innerspring insert or dampening insert having an upper lateral member, a lower lateral member parallel and spaced apart from the upper lateral member and a transverse member which extends between and bisects the upper and lower lateral Members, wherein the upper lateral member contains an arched upper surface and the lower lateral member contains an arched lower surface and wherein the upper and lower lateral members extend between and into the coils of two adjacent springs of the innerspring. The innerspring inserts are preferably made of foam material and more preferably of closed cell polyurethane foam which can be substantially compressed when installed in an innerspring and which will quickly return to its uncompressed configuration when a load on the innerspring is removed. However, the innerspring inserts described herein can be formed of any compressible and reflexive material.

In another aspect of the invention, a mattress innerspring is described having a plurality of helical form coils interconnected in an array in which the coils are generally aligned in rows and columns, each of the coils having a generally cylindrical coil body formed by helical turns of wire with openings between each of the helical turns of wire, and first and second ends to the coil body also formed by the wire, each of the coil bodies being spaced apart in the array. At least one innerspring dampening insert is located between and engaged with two or more of the coils of the innerspring, the at least one innerspring dampening insert having a lower lateral member, a vertical member which is perpendicular to and bisects the lower lateral member and a lateral extension which extends outward from one side of the vertical member. The lower lateral member extends between and into the body of two adjacent coils of the innerspring, the lateral extension extends into the body of one of the two adjacent coils and the vertical member is in contact with the two adjacent coils.

These and other embodiments of the invention are herein described with reference to the accompanying drawings.

DETAILED DESCRIPTION OF PREFERRED AND ALTERNATE EMBODIMENTS

Figure 2:
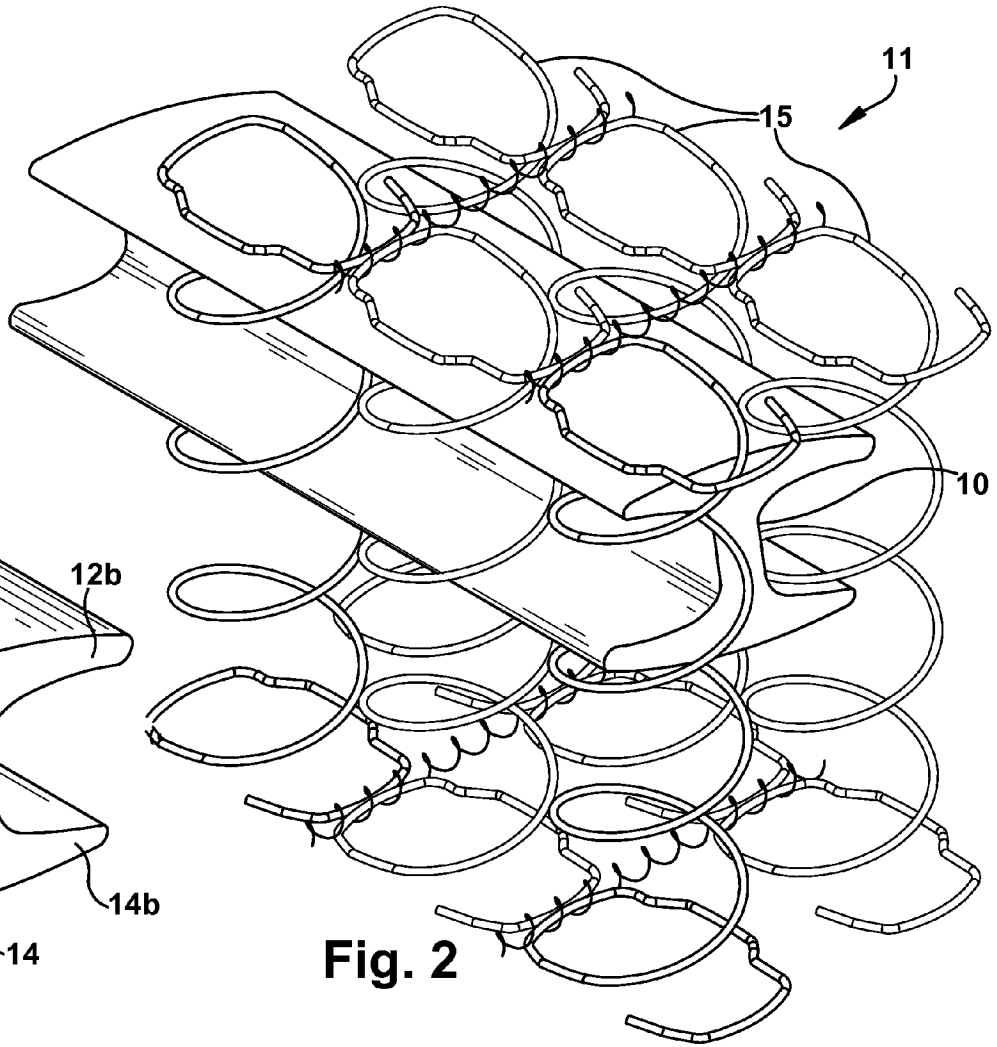
FIG. 2 is a perspective view of the innerspring with a dampening inserts of FIG. 1.

As shown in the drawings, an innerspring generally referenced at 11, has a plurality of springs or coils (herein referred to alternatively as "coils" or "springs"), although the disclosure and invention is not limited to any one particular type or form of spring or coil or innerspring other reflexive device. The coils are arranged in an array, such as an orthogonal array of columns and rows and interconnected by lacing wires which in one form are helical wires which are laced about turns of adjacent coils and typically run transverse across a width of the innerspring, but which can be run in other directions. The lacing wires can be located at either or both ends of the coils. Coil ends are formed at opposite axial ends of the coil body and aligned in the opposing (upper and lower) planes of the innerspring as described. The coil ends are aligned in planes which define support surfaces of the innerspring. In many innersprings of this type, there is open space between the adjacent coil bodies, necessary to allow flexure, compression and deflection of the coils and relative movement without inter-coil contact.

Figure 3:
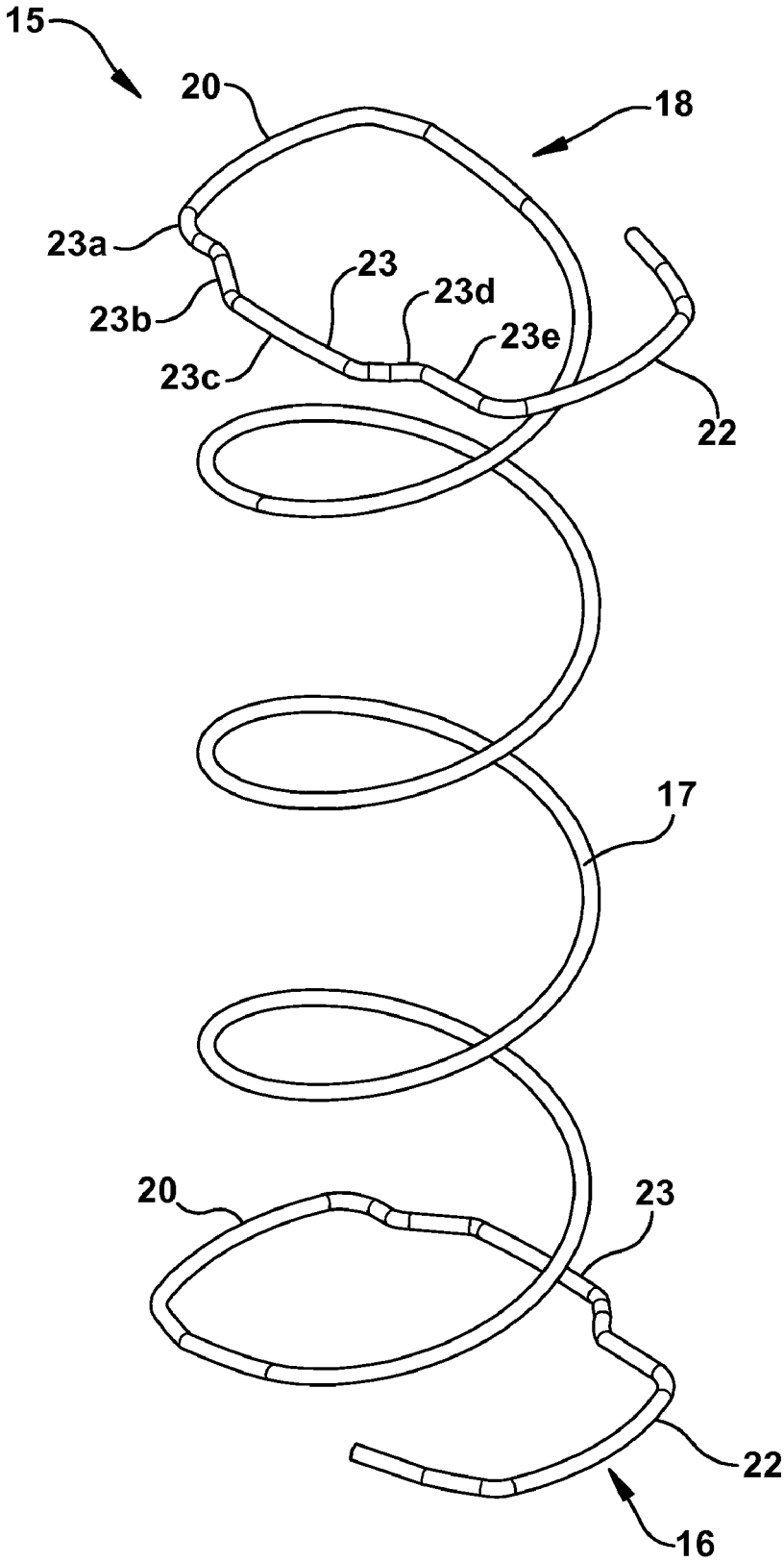
FIG. 3 is a perspective view of an innerspring coil which can be used in an innerspring with the dampening inserts of FIG. 1.

In a first embodiment of the present invention, the coils of the mattress innerspring shown are of a type referred to herein as "reverse coil head coils" (hereinafter referred to as "RCH coils") 15, which have a generally cylindrical body 17 formed by a plurality of helical turns and wherein the heads or ends of each coil are oriented 180 degrees with respect to each other, as shown in FIG. 3. The coil ends 16, 18 each have an offset and the opposing coil ends are inverted relative to each other so that they terminate on the same side of the coil body 17. The reverse coil head prevents the coil from leaning in a lateral direction when a downwardly directed load is applied to the innerspring. The generally cylindrical coil body 17 has a longitudinal axis which runs the length of the coil at the radial center of each of the helical turns of the coil 15. The coil body 17 is contiguous with the first coil end, generally indicated at 16 and a second coil end, generally indicated at 18. The designations "first coil end" and "second coil end' are for identification and reference only and do not otherwise define the locations or orientations of the coil ends. Accordingly, either the first coil end 16 or the second coil end 18 may alternatively be referred to herein as "coil end". Either of the coil ends 16, 18 may serve as the support end of the coil 15 in an innerspring in a one or two-sided mattress. Each of the coil ends 16, 18 lie generally in respective planes generally perpendicular to the longitudinal axis of the coil body 17. The coil ends 16, 18 are identical in form and have a larger diameter than the coil body 17. The coil ends 16, 18 are each formed in an open end offset configuration comprised of three offset portions and an open end. The overall shape of the coil ends 16, 18 is rectangular. Offset portions 20 and 22 have generally straight segments which are roughly parallel to each other. The third offset portion 23 extends between ends of the first 20 and second 22 offset portions and has a stepped segment of multiple contiguous segments 23*a*-23*e*. Coil ends which have one or more linear segments, such as in coil ends 16 and 18, are advantageous for allowing the coils to be more closely spaced in an innerspring array than coils with circular ends, and by providing a linear path for lacing wires that nm between coils. The coils are positioned such that the offset portions of the adjacent coils in a row overlap. The overlapped offset pairs are then secured together by spirally rotating a first set of helical coil springs across the rows so as to interlace the overlapped offset portions.

Figure 4:
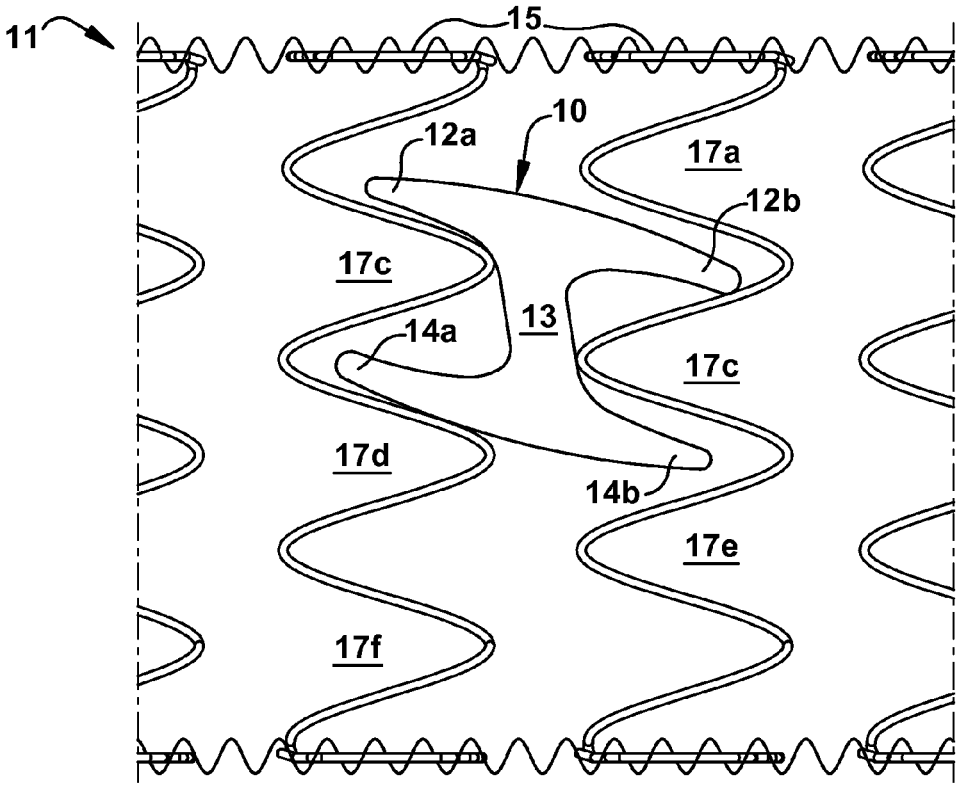
FIG. 4 is a partial side elevation of the innerspring of FIG. 2.
Figure 5:
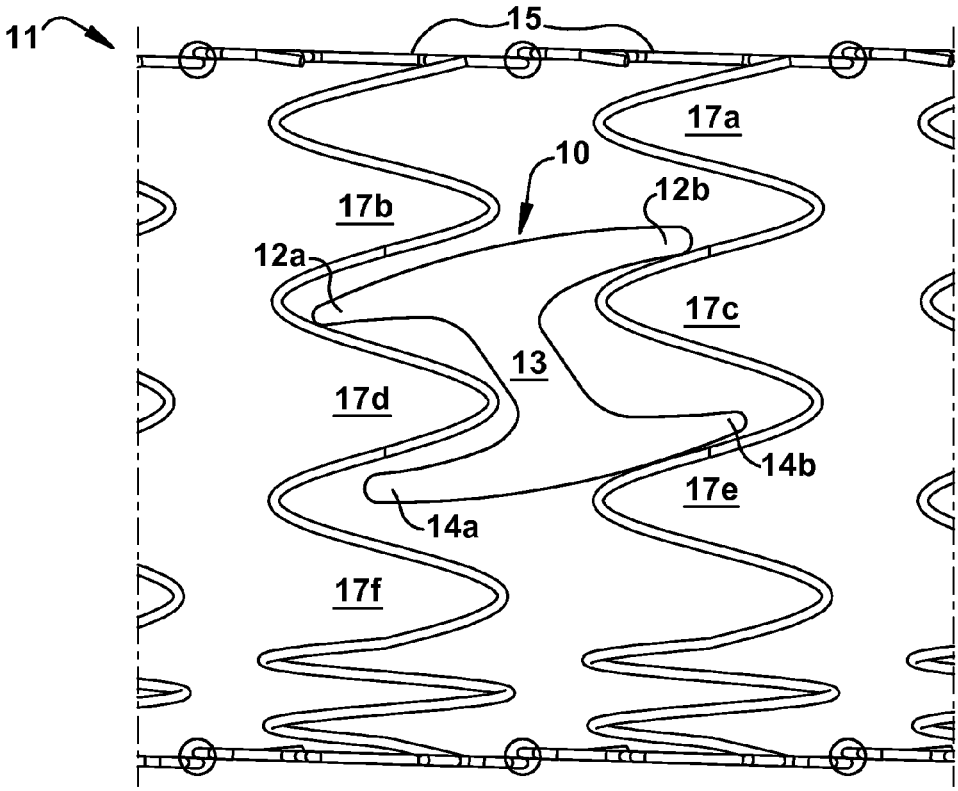
FIG. 5 is a partial end elevation of the innerspring of FIG. 2.

Since the coils are generally helical in form, the turns of each coil are laterally aligned and together form a wave-form or serpentine spaces or openings between each coil and between the rows and columns of coils in the innerspring. The spaces or openings 17 extend into the respective coil bodies. For example, as shown in FIGS. 4 and 5, the openings have different zones or areas or regions indicated at 17*a*, 17*b*, 17*c*; 17*d*, 17*e* and 17*f* (also referred to herein as "opening regions" or "spaces") defined by the helical turns of the opposing coils. The opening regions 17*a*-17*f* extend into the respective coil bodies. The number of openings will vary according to the number of helical turns of the coil body.

Figure 1:
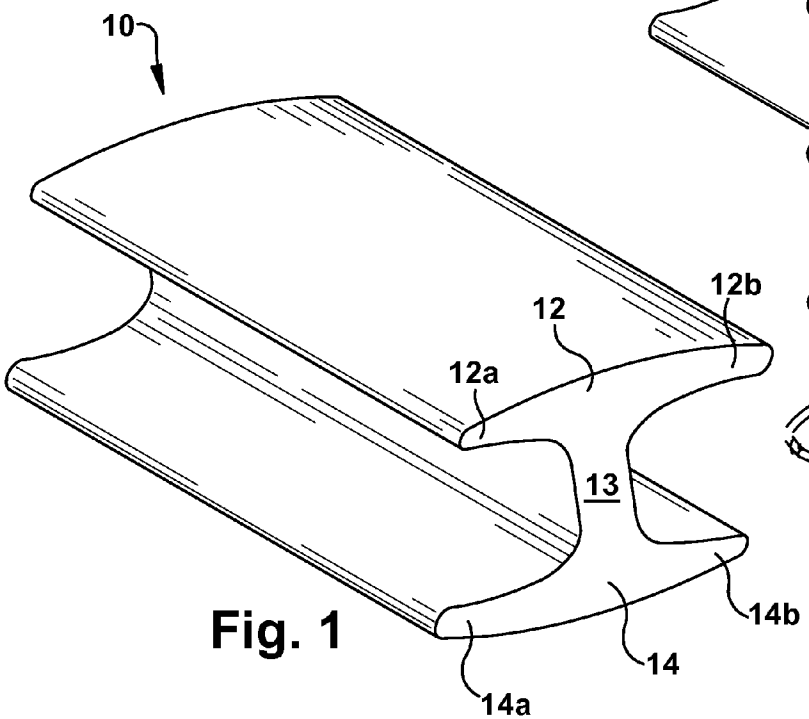
FIG. 1 is a perspective view of a first embodiment of the innerspring dampening inserts of the present invention.

A generally H-shaped innerspring insert 10 (also referred to herein in the alternative as "innerspring foam dampening insert" or "foam dampening insert" or "innerspring dampening insert" or "innerspring dampener" or "innerspring insert" or "innerspring support") can be installed and used in combination with an RCH type coil innerspring as described above and as shown in FIGS. 1 and 2, or any type innerspring which is formed by a plurality of interconnected springs or coils. The innerspring insert 10 contains upper 12 and lower 14 parallel lateral members and a transverse member 13 that extends between and bisects the upper 12 and lower 14 lateral members. The upper and lower parallel lateral members 12, 14 each include two segments 12*a*, 12*b*, 14*a*, 14*b* which fit between the coils of an innerspring, in the gaps or openings 17 formed between spaced apart coils. The innerspring inserts 10 are configured to fit within at least two or more openings 17 in order to engage with and maintain alignment with the coils. Each innerspring insert 10 has two upper segments 12*a*, 12*b* which extend from the lateral member 12 in opposing first and second directions and two lower segments 14*a*, 14*b* which extend from the lateral member 14 in opposing first and second directions. Each innerspring insert 10 has a unique slanted or angled configuration that enables the lateral segments to extend into and fit securely within the opening region between two adjacent coils or rows of adjacent coils without the use of an attachment mechanism. In a preferred embodiment, each of the transverse parallel members is approximately between 90.5 and 94.2 mm wide. The transverse member 13 that extends between and bisects the two transverse parallel members 12, 14 is approximately between 15.5 and 18.5 mm wide. The uncompressed height of the innerspring insert 10 of this embodiment is in approximate range of 55 mm to 65 mm, and more preferably in a range of 57 mm to 62 mm.

One representative cross-sectional farm of an H-shaped innerspring insert 10 of the disclosure is shown in FIG. 4. Here, the innerspring insert is positioned within the space between adjacent coils in a lengthwise direction. Section 12*a* of the innerspring insert fits within opening 17*a* of a first coil while section 12*b* is positioned within opening 17*b* of a second coil. Also, section 14*a* is located within opening 17*e* of the first coil while section 14*b* is located within opening 17*d* of the second coil. Another example of a cross-sectional form of the H-shaped innerspring insert 10 is shown in FIG. 5. In this example, the innerspring is positioned within the space between adjacent coils in a widthwise direction. Section 12*a* of the innerspring insert is positioned within opening 17*c* of a first coil and section 12*b* is positioned within opening 17*b* of a second coil. Section 14*a* is positioned within opening 17*e* of the first coil and section 14*b* is positioned within opening 17*d* of the second coil. Although the inserts are shown in a preferred embodiment in FIGS. 4 and 5 as being located in an upper region of the coils nearer or proximate to a support surface of the innerspring, they can alternatively be placed in a lower region as well, or otherwise engaged with any of the turns or convolutions of the coils, whether closer to a support surface of the innerspring, in a middle region of the innerspring, or closer to a bottom side of the innerspring. The vertical location of the innerspring inserts 10 within the innerspring is determinative of the support characteristics and feel of the mattress.

The innerspring inserts 10 are preferably made of foam material and more preferably of closed cell polyurethane foam which can be substantially compressed when installed in an innerspring and which will quickly return to its uncompressed configuration when a load on the innerspring is removed. However, the innerspring inserts described herein can be formed of any compressible and reflexive material.

Figure 6:
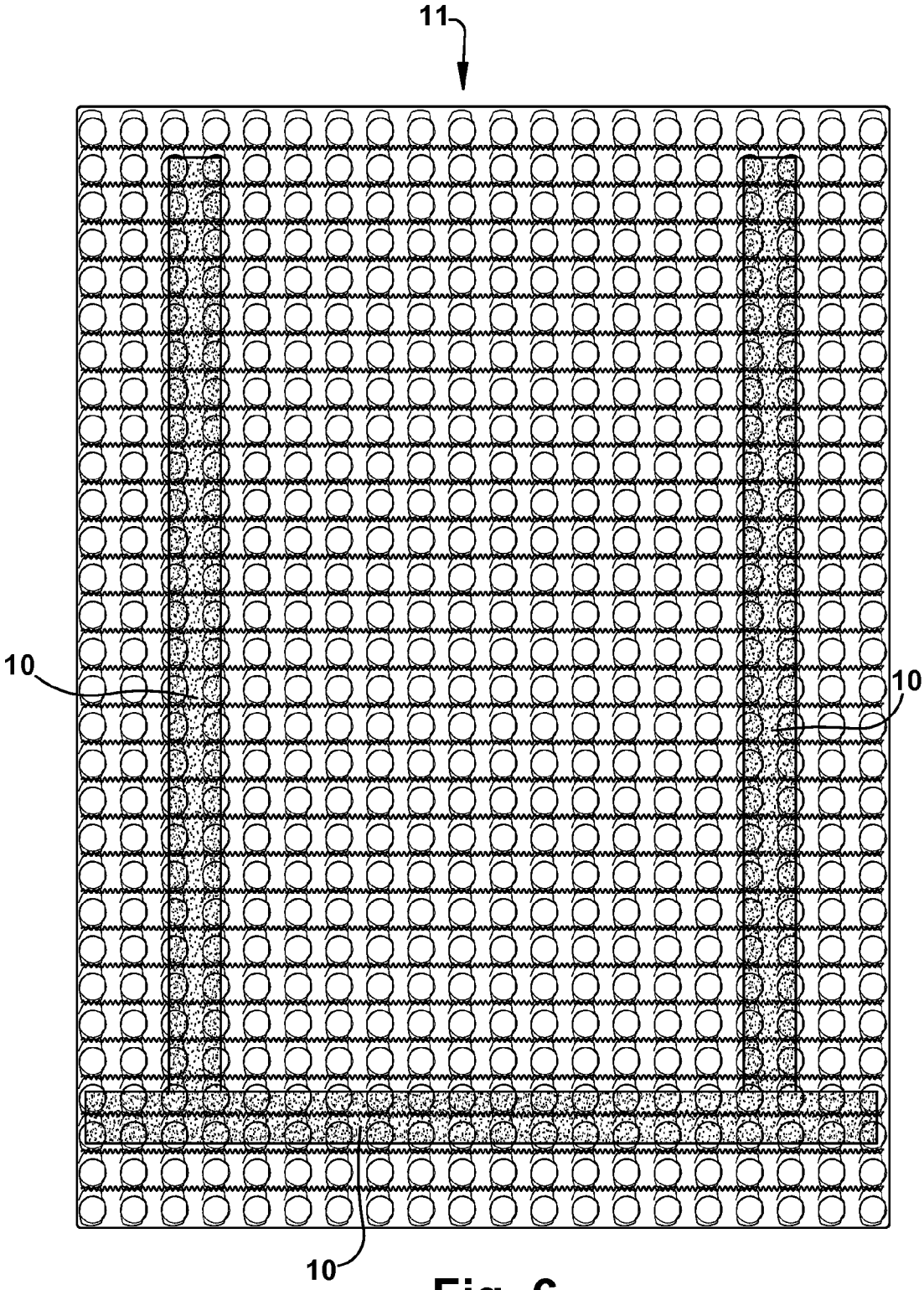
FIG. 6 is a plan view of a representative innerspring with the innerspring dampening inserts of FIG. 1.

As shown in FIG. 6, different lengths of edge support channel inserts 10 can be arranged in a generally U-shaped configuration in an innerspring, generally proximate to the right and left side edges and the bottom edge of the innerspring. This arrangement provides increased stability in the border region of the mattress. Two generally H-shaped innerspring inserts 10 are positioned in a longitudinal direction parallel to one another, with one H-shaped insert 10 positioned in a transverse direction extending between and perpendicular to the two longitudinally placed inserts 10. Each section or piece of the inserts 10 can be closely abutted with an intersection of another insert 10, or a space left therebetween. The number, size and location of the inserts 10 can also create or define zones or regions of the innerspring which have different support characteristics from other zones or regions. These can accordingly be placed or designed for particular mattress application, such as creating increased support and/or pressure-reducing areas or zones in cooperation with overlying layers of material such as foam padding layers, woven and non-woven material layers and upholstery including padded upholstery. The length of the innerspring inserts 10 for the edge supporting U-shaped configuration shown in FIG. 6 is determined according to the size of the mattress. For example, approximate lengths of each insert are set forth in the following table with respect to the various standard mattress sizes:

| | Number of 57.25" H-shaped inserts | Number of 50" H-shaped inserts | Number of 35" H-shaped inserts |
|---|---|---|---|
| Twin | 2 | 0 | 1 |
| Twin XL | 2 | 0 | 1 |
| Full | 2 | 1 | 0 |
| Full XL | 2 | 1 | 0 |
| Queen | 3 | 0 | 0 |
| King | 2 | 0 | 2 |
| Cal King | 2 | 0 | 2 |

Figure 8:
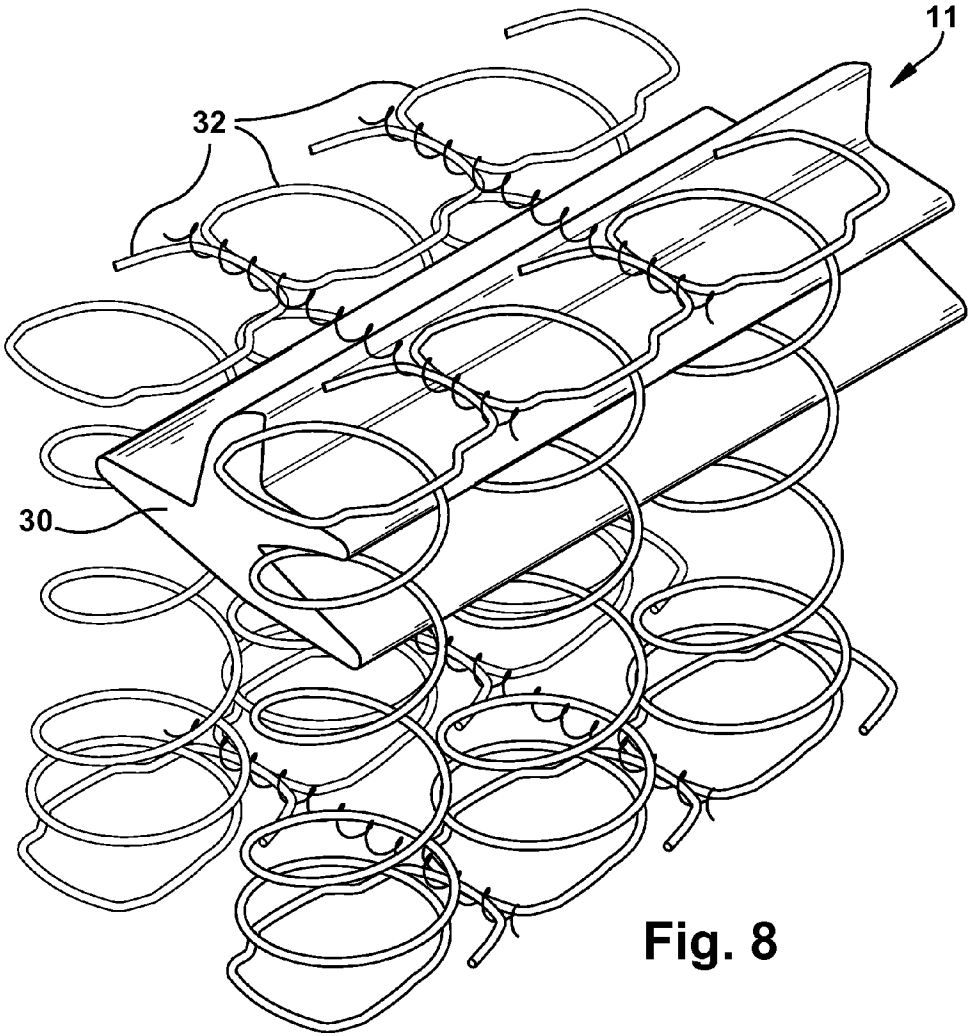
FIG. 8 is a perspective view of an innerspring with the dampening inserts of FIG. 7.
Figure 9:
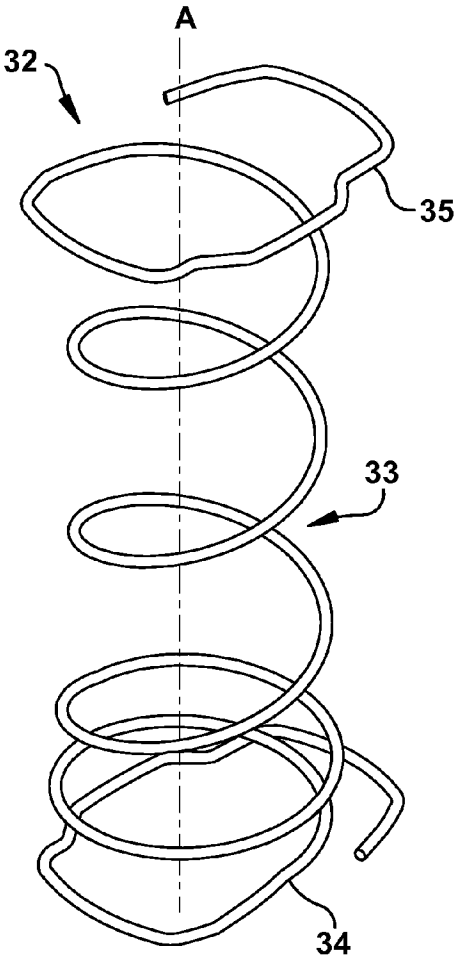
FIG. 9 is a perspective view of an innerspring coil of a type which can be used in an innerspring with the innerspring dampening inserts of FIG. 7.

In a second embodiment of the present invention, the coils of the mattress innerspring shown in FIGS. 8 and 9, are two-tiered RCH coils 32. The only difference between the RCH coil 15 as described above, and the two-tiered RCH coil 32 is that the two-tiered coil is asymmetrical about both a horizontal and vertical plane. The term asymmetric, as used herein, refers to the configuration of the coil on one side of a reference plane, such as a vertical reference plane passing through a vertical axis A of the coil body 33, or a horizontal reference plane passing perpendicularly through the axis A is different on one side of the plane than on the other. The coils 32 have a generally helical form coil body 33 which extends between a base or bottom end 34 and a top or support end 35. The base 34 and top 35 of the coil may also be referred to as the terminal convolutions. The portion of the coil body 33 on the side of the reference plane HP proximate to the top or support end is also referred to as the upper region of the coil body. The portion of the coil body 33 on the side of the reference plane HF proximate to the base or bottom end is also referred to as the lower region. As is known in the art, the primary factors which determine the spring rate and resultant feel of a spring are wire gauge, the size (diameter) and the pitch (or pitch angle) of the helical turns of the coil. In generally, the more turns to the coil the lower the spring rate, with a resultant softer feel and support. Larger diameter turns in a coil also contribute to a lower spring rate and consequent softer feel. The greater or steeper the pitch, the stiffer the spring is, due to increased vertical orientation of the wire.

Figure 10:
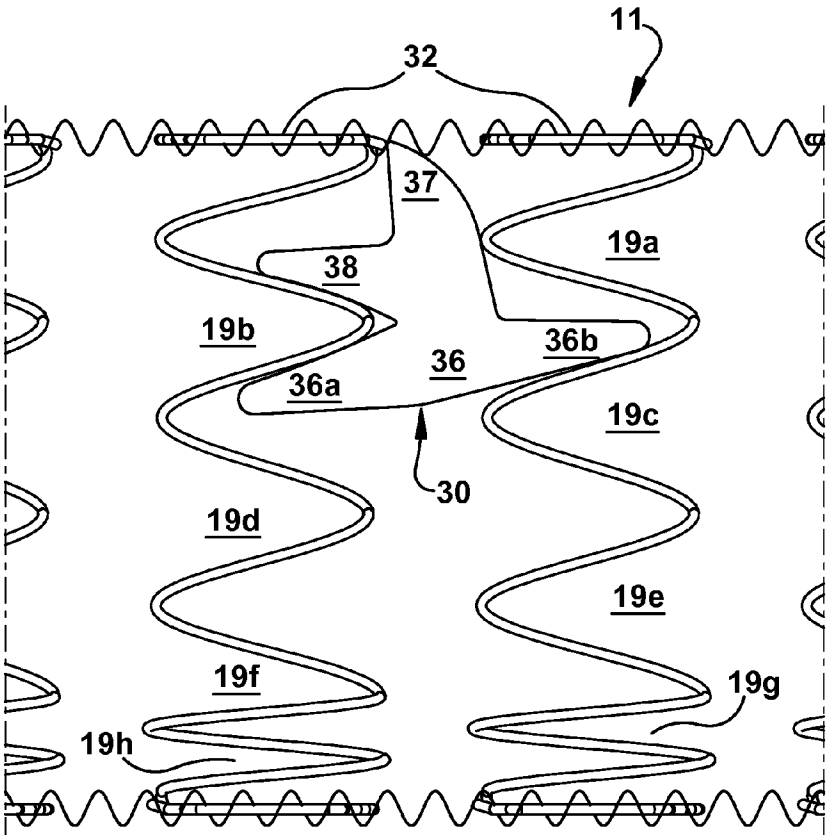
FIG. 10 is a partial side elevation of the innerspring of FIG. 8.

As can be seen in FIGS. 9 and 10, the pitch angle between the turns or convolutions in the upper region of the coil is much smaller than the pitch angle between the turns or convolutions in the lower region of the coil. When a coil is positioned with turns closer together as in the upper region of the coil shown in FIGS. 9 and 10, the top of the coil is softer. The diameter of each of the turns is identical except for the second turn from the top of the coil, which in this embodiment happens to have the largest diameter of the coil body.

Figure 7:
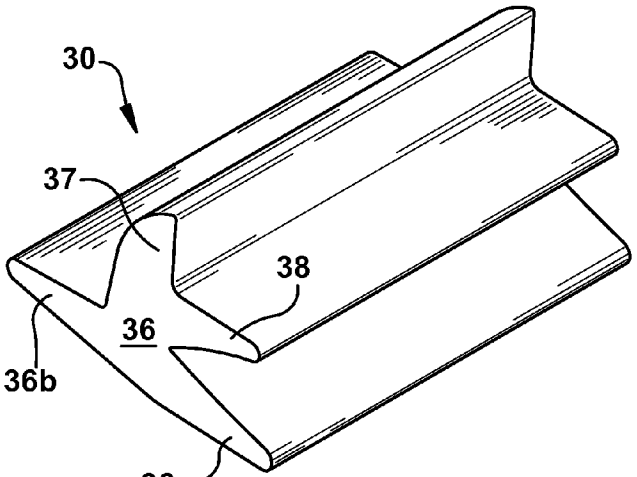
FIG. 7 is a perspective view of a second embodiment of the innerspring dampening inserts of the present invention.

A generally T-shaped innerspring dampening insert 30, shown in FIGS. 7 and 8 is used in combination with a two-tiered RCH coil innerspring, as described above. The generally T-shaped innerspring insert 30 contains a lower lateral member 36 and a vertical member 37 which is perpendicular to and bisects the lower lateral member 36. The vertical member 37 additionally contains a lateral extension 38 which extends outward from one side of the vertical member 37. The lower lateral member 36 contains a right portion **36*a* and a left portion 36*b*. These innerspring inserts 30 are designed to fit between the spaces or openings between two two-tired RCH coils 32 in adjacent rows of the innerspring. A first portion of the lower lateral member 36*a* and the lateral extension 38 of the vertical member 37 fit between two adjacent coils of the same spring. A second portion of the lower lateral member 36*b* extends into the turns of a coil located in an adjacent row of the innerspring. In a preferred embodiment, the generally T-shaped innerspring insert 30** is between approximately 72.5 and 77.5 mm wide and approximately between 44.5 and 49.5 mm high. The width of the vertical member, at its largest point, is approximately between 18.5 and 21.5 mm and the height from the lower lateral member to the top of the lateral extension is approximately between 26.5 and 29.5 mm.

A representative cross-sectional form of the T-shaped innerspring insert 30 of the disclosure is shown in FIG. 10. The spaces or openings between two adjacent two-tier RCH coils, referred to as openings **19*a*-19*b*, accommodate the various sections of the T-shaped inserts. For example, the right portion 36*a* of the lower lateral member 36 is positioned within opening 19*c* of a first coil and the left portion 36*b* is positioned within opening 19*b* of a second coil. The lateral extension 38 is positioned within opening 19*a* of the first coil. Vertical member 37** is in contact with both the first and second coils.

Figure 11:
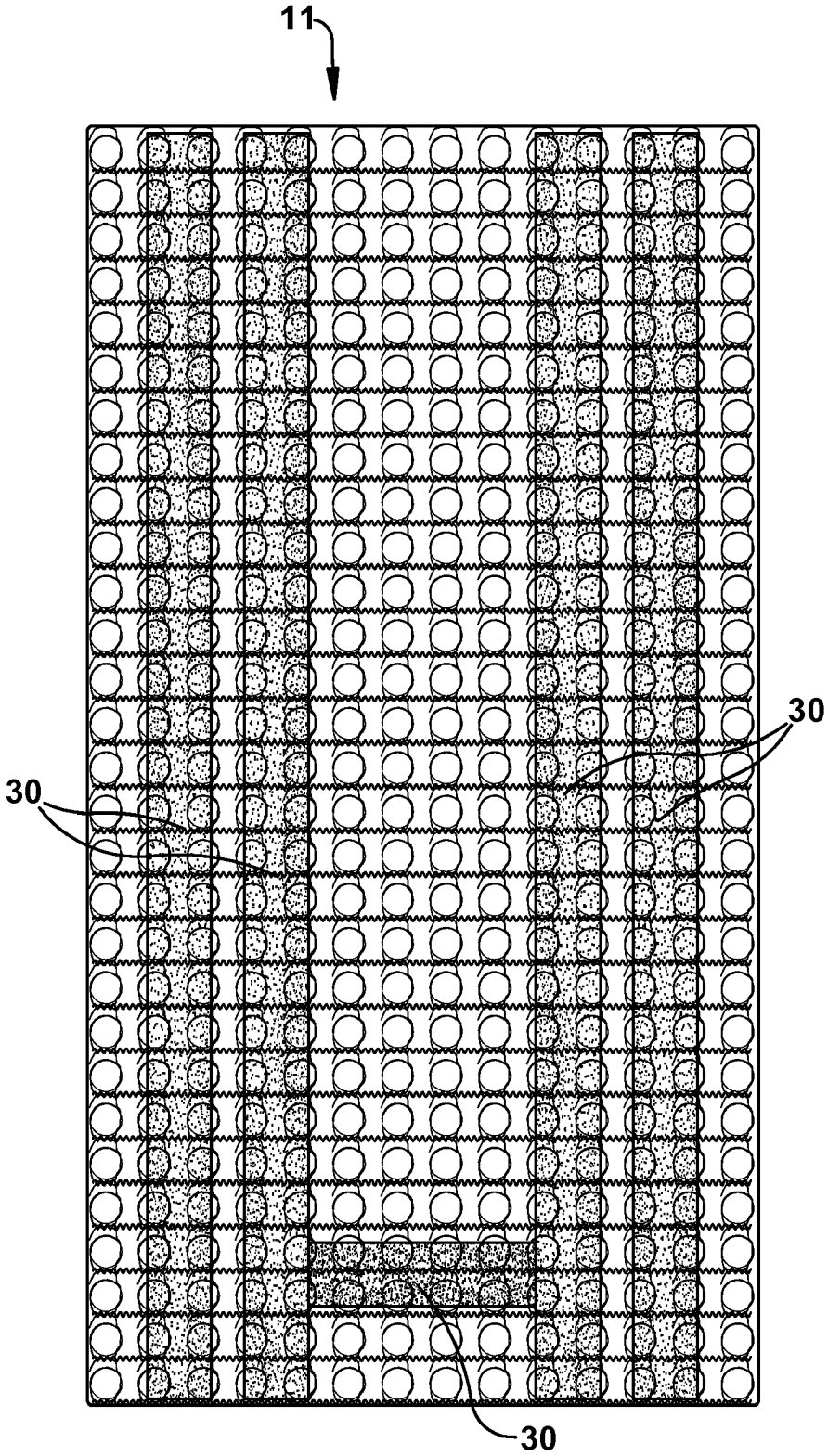
FIG. 11 is a plan view of a representative innerspring with the innerspring dampening inserts of FIG. 7.

As shown in FIG. 11, a plurality of generally T-shaped innerspring inserts 30 are positioned along two rows proximate to and running along the length of the right side of the innerspring, along two rows proximate to and running along the length of the left side of the innerspring, and along one horizontal row proximate to the foot of a mattress and extending substantially between the two right side and two left side rows of innerspring inserts. The following chart sets forth representative examples of the various sized T-shaped channels used for different mattress sizes:

| | Number of 76.0" T-shaped inserts | Number of 71.0" T-shaped inserts | Number of 45.0" T-shaped inserts | Number of 33.0" T-shaped inserts | Number of 25.0" T-shaped inserts | Number of 10.75" T-shaped inserts |
|---|---|---|---|---|---|---|
| Twin | 0 | 4 | 0 | 0 | 0 | 1 |
| Twin XL | 4 | 0 | 0 | 0 | 0 | 1 |
| Full | 0 | 4 | 0 | 0 | 1 | 0 |
| Full XL | 4 | 0 | 0 | 0 | 1 | 0 |
| Queen | 4 | 0 | 0 | 1 | 0 | 0 |
| King | 4 | 0 | 1 | 0 | 0 | 0 |
| Cal King | 4 | 0 | 1 | 0 | 0 | 0 |

Although the examples and figures herein describe an innerspring having innerspring inserts which may serve as edge supports along three sides of the innerspring, any number of innerspring inserts of any size may be inserted into an innerspring, including along all four sides of the innerspring at or proximate to the edges of the innerspring, and these various configurations are all considered to be within the scope of the present invention.

In a preferred embodiment, both the H-shaped and T-shaped innerspring inserts described above are made of 100% low density polyethylene foam with a density of approximately 1.25 lb/ft$^3$, although other materials and densities are within the scope of the invention. Also, the density or compression force of the inserts when made of foam, such ILD and IFD properties can be selected for the desired degree of dampening or spring rate modification of the combination of an innerspring with the innerspring inserts. For example, innerspring inserts made of a foam of relatively lower ILD or IFD measurements may be combined with an innerspring with springs having a relatively lower spring rate or vice versa, or made of a foam of relatively higher ILD or IFD measurements may be combined with an innerspring with springs having a relatively higher spring rate or vice versa. Also, the invention can be embodied with relatively high ILD or IFD foam by which the innerspring insert provide substantial support and structural strength to the innerspring or core unit.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A mattress innerspring comprising:

an innerspring formed by a plurality of springs connected together in an array wherein the springs are arranged in rows and columns, each spring having a body with a first end and a second end, the body of each spring being generally cylindrical and having a longitudinal axis and an outer diameter, the springs being spaced apart in the rows and columns and connected together in a spaced apart arrangement with each spring being spaced from each adjacent spring in the array;

at least one innerspring dampening insert located in the innerspring in spaces between springs of the innerspring, the innerspring dampening insert having an upper lateral member, a lower lateral member parallel and spaced apart from the upper lateral member and a transverse member which extends between and bisects the upper and lower lateral members;

wherein the upper lateral member contains an arched upper surface and the lower lateral member contains an arched lower surface; and wherein the upper and lower lateral members extend between and into and at least partially intersect a longitudinal axis of two adjacent springs of the innerspring.

2. The mattress innerspring of claim 1, wherein the at least one innerspring dampening insert is positioned within the spaces between springs of the innerspring in a slanted orientation.

3. The mattress innerspring of claim 1, wherein each of the plurality of springs are reverse coil head (RCH) type coils.

4. The mattress innerspring of claim 1, wherein a height dimension of the at least one innerspring dampening insert is in an approximate range of between 57 and 60 mm.

5. The mattress innerspring of claim 1, wherein a width dimension of the at least one innerspring dampening insert is in an approximate range of between 90.5 and 94.2 mm.

6. The mattress innerspring of claim 1, wherein three innerspring dampening inserts are located in an innerspring in a generally U-shaped configuration.

7. The mattress innerspring of claim 1, wherein a first innerspring dampening insert is positioned along a length of a first side of the innerspring, a second innerspring dampening insert is positioned parallel to the first innerspring dampening insert and along the length of a second side of the innerspring and a third innerspring dampening insert is positioned perpendicular to both the first and second innerspring dampening inserts along the width of a third side of the innerspring.

8. The mattress innerspring of claim 7, wherein the first and second innerspring dampening inserts are approximately 57.25 inches long and the third innerspring insert is approximately between 35 and 57.25 inches long.

9. The mattress innerspring of claim 1 having at least two innerspring dampening inserts positioned parallel to each other within the innerspring.

10. The mattress innerspring of claim 9, wherein the at least two innerspring dampening inserts are positioned proximate to opposing edges of the innerspring.

11. The mattress innerspring of claim 7, wherein the first, second and third innerspring dampening inserts are positioned proximate to three edges of the innerspring.

12. A mattress innerspring comprising:

a plurality of helical form coils interconnected in an array in which the coils are generally aligned in rows and columns, each of the coils having a generally cylindrical coil body formed by helical turns of wire with openings between each of the helical turns of wire, and first and second ends to the coil body also formed by the wire, each of the coil bodies being spaced apart in the array;

at least one innerspring insert located between and engaged with two or more of the coils of the innerspring, the at least one innerspring insert having a lower lateral member, a vertical member which is perpendicular to and bisects the lower lateral member and a lateral extension which extends outward from one side of the vertical member;

wherein the lower lateral member extends between and into and at least partially intersects a longitudinal axis of two adjacent coils in the innerspring, the lateral extension extends into the body of one of the two adjacent coils, and the vertical member is in contact with the two adjacent coils.

13. The mattress innerspring of claim 12, wherein the plurality of helical form coils are two-tier RCH coils.

14. The mattress innerspring of claim 12, wherein the plurality of helical form coils are asymmetrical.

15. The mattress innerspring of claim 12, wherein the at least one innerspring insert is approximately between 72.5 and 77.5 mm wide.

16. The mattress innerspring of claim 12, wherein the at least one innerspring insert is approximately between 44.5 and 49.5 mm in length.

17. The mattress innerspring of claim 12, wherein the at least one innerspring insert is made of polyethylene.

18. The mattress innerspring of claim 12, wherein the at least one innerspring insert has a density of approximately 1.25 $lb/ft^3$.

19. The mattress innerspring of claim 12, wherein there are at least two innerspring inserts that are positioned parallel to each other within the innerspring.

20. The mattress innerspring of claim 12, wherein there are at least three innerspring inserts that are positioned in a generally U-shaped configuration within the innerspring.

21. The mattress innerspring of claim 1, wherein a cross-sectional configuration of the at least one innerspring dampening insert conforms to one or more turns of a spring of the innerspring.

* * * * *